US007967897B2

(12) United States Patent
Huziwara et al.

(10) Patent No.: US 7,967,897 B2
(45) Date of Patent: Jun. 28, 2011

(54) SYSTEM AND PROCESS FOR THE SEPARATION OF SUSPENSIONS OF SPENT CATALYSTS AND HYDROCARBONS FORMED IN A FLUID CATALYTIC CRACKING UNIT WITH MULTIPLE ASCENDING FLOW REACTION TUBES

(75) Inventors: Wilson Kenzo Huziwara, Rio de Janeiro (BR); Emanuel Freire Sandes, Niterói (BR); Luiz Carlos Casavechia, São Mateus do Sul (BR); José Geraldo Furtado Ramos, Rio de Janeiro (BR); Andrea De Rezende Pinho, Rio de Janeiro (BR); Shelton Rolim Cercal, Sã Mateus do Sul (BR); Aurelio Medina Dubois, Rio de Janeiro (BR); Paulo Sergio Freire, Rio de Janeiro (BR); Nelson Patricio Junior, Rio de Janeiro (BR)

(73) Assignee: Petróleo Brasileiro S.A. - Petrobras, Rio de Janeiro (BR)

( * ) Notice: Subject to any disclaimer, the term of this patent is extended or adjusted under 35 U.S.C. 154(b) by 331 days.

(21) Appl. No.: 12/183,546

(22) Filed: Jul. 31, 2008

(65) Prior Publication Data

US 2009/0142241 A1 Jun. 4, 2009

(51) Int. Cl.
*F27B 15/09* (2006.01)
*B01D 45/12* (2006.01)

(52) U.S. Cl. ..... 95/271; 422/139; 422/141; 422/144; 422/145; 422/147

(58) Field of Classification Search ..... 95/271; 422/139, 141, 144, 145, 147
See application file for complete search history.

(56) References Cited

U.S. PATENT DOCUMENTS

| | | | | |
|---|---|---|---|---|
| 5,391,289 | A * | 2/1995 | Forde et al. | 208/113 |
| 5,569,435 | A | 10/1996 | Fusco et al. | |
| 5,665,949 | A | 9/1997 | Fusco et al. | |
| 5,837,129 | A | 11/1998 | Ross, Jr. et al. | |
| 5,843,377 | A * | 12/1998 | Fandel et al. | 422/144 |
| 6,113,777 | A | 9/2000 | Gauthier et al. | |
| 7,713,491 | B2 * | 5/2010 | Claude | 422/147 |
| 7,744,745 | B2 | 6/2010 | Alvarenga-Baptista et al. | |
| 7,771,585 | B2 * | 8/2010 | Vimalchand et al. | 208/113 |
| 2004/0251166 | A1 | 12/2004 | Alvarenga Baptista et al. | |
| 2006/0177357 | A1 | 8/2006 | Yuan et al. | |
| 2006/0283777 | A1 * | 12/2006 | Alvarenga Baptista et al. | 208/120.1 |

* cited by examiner

FOREIGN PATENT DOCUMENTS

| | | |
|---|---|---|
| BR | PI 0405873-9 | 12/2004 |
| BR | PI 0302325-7 | 3/2005 |

*Primary Examiner* — Walter D Griffin
*Assistant Examiner* — Huy-Tram Nguyen
(74) *Attorney, Agent, or Firm* — Nixon & Vanderhye PC

(57) ABSTRACT

The present invention relates to a system for the separation of suspensions of spent catalysts and hydrocarbons formed in an FCC unit with multiple ascending flow reaction tubes, comprising interconnections between each of the ascending flow reaction tubes and the separator vessel, each interconnection also comprises two sections. The outside sections of the separator vessel are inclined and are connected to a single vertical section, which penetrates into the interior of the separator vessel, and which has at its lower end an open device for draining the spent catalyst from the suspensions separated in this sector. In the same vertical section, at the end of its internal part at the separator vessel, a series of two sets of cyclones are installed, the first set containing cyclones without sealing legs, and the second set containing conventional cyclones of the first stage. The present invention also relates to a process for the separation of suspensions of spent catalysts and hydrocarbons using the said separation system.

11 Claims, 4 Drawing Sheets

SYSTEM AND PROCESS FOR THE SEPARATION OF SUSPENSIONS OF SPENT CATALYSTS AND HYDROCARBONS FORMED IN A FLUID CATALYTIC CRACKING UNIT WITH MULTIPLE ASCENDING FLOW REACTION TUBES

This application and claims priority to Brazilian Patent Application No. PI 0704443-7 filed Nov. 30, 2007, the entire contents are hereby incorporated by reference.

FIELD OF THE INVENTION

The present invention relates to a system and process for the separation of suspensions of spent catalysts and hydrocarbons formed in fluid catalytic cracking units (FCCUs) with multiple ascending flow reaction tubes, hereinafter "risers".

More specifically, the present invention relates to a known system of termination of risers to be used in the separation of suspensions containing spent catalysts and mixture of cracked hydrocarbons, these suspensions forming at the outlet of the risers of FCCUs equipped with more than one riser in parallel.

The invention also relates to a process for the separation of these suspensions of spent catalysts and hydrocarbons which are formed in these types of units.

BASIS OF THE INVENTION

The object of the fluid catalytic cracking process (FCC) is to convert liquid hydrocarbons of high molecular weight, generally exhibiting an initial boiling point (IBP) in the range from 320° C. to 390° C., in light hydrocarbon fractions such as gasoline (IBP about 30° C.) and liquid petroleum gas (maximum vapour pressure of 15 kgf/cm$^2$ at 37.8° C.).

The stages of the FCC process are fully known to persons skilled in the art and are described in various patents. Considered of particular importance is the process described in Brazilian Patent PI 9303773-2, incorporated in full herein as reference.

One of the stages of the fluid catalytic cracking process is the separation of the spent particles from the reactive mixture of cracked hydrocarbons, which make up the suspension which emerges from the risers when hydrocarbons are brought into reaction in the presence of specific catalysts. Such separation, carried out in a separator vessel, is done by means of systems which make use of deflection mechanisms (inertial systems), which use the inertial force of the particles to separate them, or systems which use devices referred to as cyclones which make use of centrifugal force to carry out such separation.

Cyclones may be classified in two categories. Cyclones referred to as "confiners", which are characterised by temporarily confining, by means of special "flapper" type valves, for example, particles separated from the spent catalyst in its funnel-shaped parts, referred to hereinafter as "sealing legs", while the hydrocarbon vapours are released via overhead ducts.

Cyclones without sealing legs, also referred to as "pseudo-cyclones", do not retain the separated particles and consequently release them as soon as they are separated, by way of their lower open parts, directly to the separator vessel, whereby they simultaneously release the cracked hydrocarbon vapours via the overhead ducts.

In general, separation devices in their various different types function adequately. Nevertheless, new types of petroleum, increasing demands on productivity, and the protection of the environment require improvement of the traditional FCC processes, incurring additional difficulties for these types of separation.

For example, an increase in the conversion rates of gasoline hydrocarbons in FCC processes has only been possible since the development of more thermally stable catalysts, with high selectivity and activity. Such characteristics at the same time allow for operational temperatures to be increased and dwell time in the risers to be decreased, creating an additional problem for the termination systems of these risers. Such a problem highlights the necessities for dwell time in the cyclones and the separator vessel, the operation of which is beginning to represent a restriction on the discharge rate which is disproportional to the permissible dwell time of reagents in the riser.

The reaction conditions normally used to maximise the production of gasoline, making use of catalysts of the latest generation, can achieve dwell times capable of attaining the range from 0.2 to 0.1 second. Under these conditions, the separation equipment can take more time for separation than is available for contact between the two phases in the risers, resulting in degradation of the products, excessive formation of coke, and low production.

Another problem which arises for separation equipment involves FCC units with multiple risers. Arising from the need for greater flexibility of operation in integrated refineries, these units allow for each riser to operate under different conditions, such that all of them empty their reactive mixtures into separation equipment units mounted in the interior of one single separator vessel, where the separated catalysts are submitted to correction operations ("stripping"), to be regenerated subsequently.

In consequence, this means that in the most modern FCC processes there is a simultaneous increase in volume, in the catalyst/hydrocarbons ratio, in the flow rate of the suspension to be separated, and in the quality of the products created. Taking account of the fact that operations in the risers tend to be unstable, since sudden increases in pressure are common, of the order of 2 to 20 times in the original design format, the result is that there is a considerable increase in the complexity not only of the operation but also of the process of separation of the suspensions containing spent FCC catalysts and the hydrocarbons produced in such units. The structural and mechanical assembly of the unit, moreover, is already not so simple, given the large volume and weight which the unit in question acquires when using a separation system for each riser.

Examples of operations with FCC units provided with multiple risers are described in Brazilian Patents PI0302325-7 and PI 0205585-6, also incorporated in full as references, in which a number of different operational conditions are presented which can be used in each of the multiple risers of these types of units.

ASSOCIATED PRIOR ART

Brazilian Patent PI 9303773-2 describes a separation system which uses isolated riser termination systems particularly specified to be used in FCC processes, which essentially comprises a cyclonic separation device which is directly connected to the riser and which is designed in such a way as to avoid the restricting of the catalysts collected across one leg. Specifically, this involves a cyclone without a leg (pseudo-cyclone), open in its lower section directly into the separator vessel, which takes advantage of the large volume of the separator vessel to absorb the possible operational discontinuity of the riser while maintaining a sufficiently efficient separation. In consequence, all the advantages are maintained due to the rapid separation between the reactive gaseous phase and the suspension of catalyst particles with its reduced activity and selectivity. The gaseous phase of cracked hydrocarbons undergoes other separation processes before being released for subsequent refinery treatments.

Also described is a new process of fluid catalytic cracking using the said pseudo-cyclone, which offers improvements in relation to the prior art, in particular with regard to overcoming the problem of the operational discontinuity of the riser.

More recent research indicates that co-existence can be maintained of the use of inertial separation systems and systems comprising cyclones, both confiners as well as non-confiners. American Patents U.S. Pat. No. 5,837,129 and U.S. Pat. No. 6,113,777, for example, exhibit inertial separator devices of the "ram's horn" type, directly connected to the terminations of the risers, located internally in the regenerator vessel, and provided with gas outlets arranged horizontally and connected to them, which move the said separator device from the centre towards their upper part. These patents teach that the use of these devices provides rapid and efficient separation of the hydrocarbon vapours from the catalyst particles, and, by reducing the contact time between the product vapours and the catalyst particles in the separation zone of the separator vessel, reduce the thermal cracking of these products.

The application for American Patent US 2006/0177357 exhibits a variation of the configuration of the separation devices described heretofore, in which the operational deficiencies of the sealing legs of the confiner cyclones are circumvented by the use of sealing devices of the "bathtub" type, which have holes in the base to fluidise the catalysts retained in them and apertures in the upper part to allow for the discharge by effusion of the fluidized catalysts. Such fluidization is obtained by means of a correction gas, such as water vapour or some other gas normally used in these correction operations.

Brazilian Patent PI 0405873-9 exhibits a mixed termination system, which uses both types of devices (inertial and centrifugal) for the separation of suspensions of spent catalysts and hydrocarbons in FCC units which have a descending flow reactor ("downer").

Finally, an analysis of the present state of the art indicates a development in FCC processes aimed at meeting in an adequate manner the more severe operational conditions involved. In other words, separation systems must continue to function in the face of the need for minimal dwell times in the risers, subject to high catalyst/hydrocarbon ratios, and still being resistant to high erosion pressures of the material.

The state of the art, however, does not exhibit separation systems which are capable of dealing with operations directed at maximising the production of olefins, operations which require a high catalyst/hydrocarbon ratio in the risers, resulting in the use of multiple risers to crack the flows recycled from the main reactor, additional loads, and segregated loads with processing under different operational conditions.

The object of the present invention is to resolve this problem by proposing a new separation system, with much simpler and more compact assembly, which simultaneously integrates inertial and centrifugal separation devices, the latter being both confiners as well as non-confiners, in an innovative configuration which makes it possible to operate FCC units with multiple risers under extreme operating conditions.

The present invention significantly increases the efficiency of separation of the suspensions containing spent catalysts and a mixture of cracked hydrocarbons, then only 10%-15% of the spent catalyst would need to be separated in the cyclones.

SUMMARY OF THE INVENTION

The present invention involves a system for the separation of suspensions of spent catalysts and hydrocarbons formed in FCC units with multiple ascending flow reaction tubes (risers), consisting of:

a) Interconnections between each of the ascending flow reaction tubes, risers, and the separator vessel consisting of two interconnected sections, the first section being inclined, starting at the upper end of the risers and forming an acute angle with them, and enclosed at the top of the outside part of the second vertical interconnection section, which joins the interconnections and penetrates into the upper cover of the separator vessel, and which has a regulatable opening device, connected at its lower end, in order to drain the part of the spent catalyst separated from the suspensions;

b) Cyclones without sealing legs, located in the interior of the separator vessel, which are connected directly to the walls of the lower third of the said second vertical section of the interconnections described in (a); and c) Conventional first-stage cyclones, also located in the interior of the separator vessel, connected to the cyclones without sealing legs by way of overhead ducts for the outlet of gases from the cyclones without sealing legs described in (b), the sealing legs of which, whether provided with controller devices for the retention of solids, extend or not as far as the interior of the fluidized bed present in the separator vessel.

The present invention also relates to a process for the separation of suspensions of spent catalysts and hydrocarbons formed in FCC units with multiple ascending flow reaction tubes, risers, using the system referred to above, this process consisting of the following stages:

1. Feeding of loads comprising catalysts and hydrocarbons into each of the risers of an FCC unit with multiple ascending flow reaction tubes, risers;
2. Submitting the said loads to a fluid catalytic cracking reaction in each of the risers;
3. After the reaction in b), arranging for the suspensions of particles of spent catalysts and cracked hydrocarbons, produced in the said reaction and expelled through the upper ends of each of the risers (i) reaching the first inclined sections of the interconnections between each of the risers and the separator vessel; (ii) continuing in descending flow until they reach the second vertical section of the interconnections between each of the risers and the separator vessel, where the particles of spent catalyst begin to separate from the cracked hydrocarbons; and (iii) discharging into the interior of the separator vessel through the central orifice of the inverted cone which is connected to the lower end of the second vertical section of the interconnections between each of the risers and the separator vessel;
4. Forcing the suspension with the spent catalyst remaining from the draining process in (iii) to penetrate into the cyclones without sealing legs, where more particles of spent catalyst are separated and drain into the interior of the separator vessel through the lower open parts of the cyclones without sealing legs, while the gaseous cracked hydrocarbons separated from the suspension pass through overhead ducts of the said cyclones without sealing legs and reach the conventional cyclones of the first stage in order to undergo one more separation stage; and 5. Releasing the said gaseous cracked hydrocarbons from the FCC unit through overhead ducts of the conventional cyclones of the first stage to subsequent processing, while the particles of spent catalysts, separated from the suspension, drain via the sealing legs of the conventional cyclones of the first stage, enter the fluidized bed, and after correction in the separator vessel, follow in the process in order to be regenerated and reused.

BRIEF DESCRIPTION OF THE DRAWINGS

The system and process of separation of suspensions of spent catalysts and hydrocarbons from the FCC multiple riser unit (FCCU), the objects of the present invention, will be described in detail hereinafter, based on the figures referred to below, which are an integral part of this Description.

DETAILED DESCRIPTION OF THE INVENTION

Figure 1:
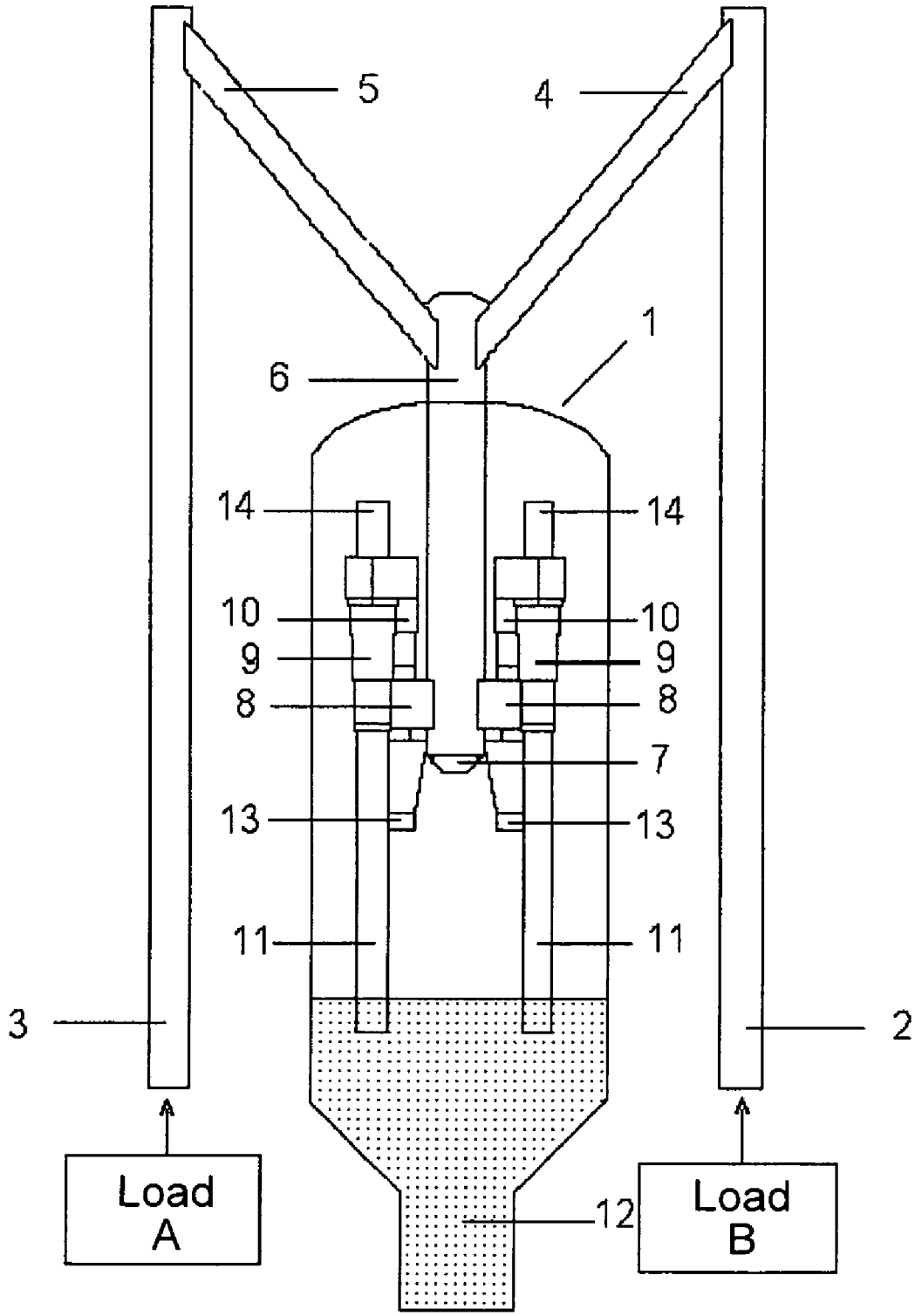
FIG. 1 shows a diagrammatic representation of the system for the separation of suspensions of spent catalysts and hydrocarbons of the present invention, installed in the interior of a separator vessel of a typical FCC unit, in which are shown at least two ascending flow reaction tubes, "risers".

In order to be better understood, the detailed description of the system and the process for the separation of suspensions of spent catalysts and hydrocarbons in FCCUs with multiple risers, the object of the present invention, will be provided on the basis of the figures, in accordance with the identification of the respective components FIG. 1 shows a simplified diagrammatic representation of a typical separator vessel (1) of an FCC unit, in which are represented at least two risers (2 and 3), a number of ascending flow reaction tubes (risers) which can comprise one unit, in which the fluid catalytic cracking process takes place of the hydrocarbons from two loads A and B, composed of mixtures of hydrocarbons and catalyst, which can be fed into the said risers (2 and 3) in proportions (ratio of catalyst to hydrocarbon), flow rates, reaction temperatures, dwell times and hydrocarbon mixtures, but which cannot however use different catalysts nor operate at different pressures, for reasons which are obvious and perfectly comprehensible to persons skilled in the art.

After being submitted to cracking in the risers (2 and 3), the loads A and B referred to are transformed into finely divided suspensions of particles of spent catalysts and a mixture of gaseous cracked hydrocarbons as a majority (between 90 and 95% of the volume of the mixture), and move to the upper end of the risers (2 and 3) in order to reach the first inclined sections (4 and 5) of the interconnections between the said risers (2 and 3) and the separator vessel (1). The said inclination varies in the range from 35° to 50°. At this point the particles of the spent catalysts from the suspensions undergo a first deflection in order to reach the walls of the inclined sections (4 and 5) and, by virtue of having their direction drastically changed, they have reduced velocities; due to inertia, they begin to to separate from the mixture of cracked hydrocarbons.

The particles of the spent catalysts from the suspensions deriving from the inclined sections (4 and 5) arrive at a second vertical section (6) which connects the interconnections between the risers (2 and 3) and the separator vessel (1), in which the separation takes place of a good part of the spent catalyst from the mixture of cracked hydrocarbons. A portion from 80% to 85% of the mass of particles of spent catalyst drains through an orifice present at the vertex of the inverted cone (7). This inverted cone (7) forms an angle of between 50° and 70° with its generatrix, and is provided with a mechanism which regulates the diameter of the said orifice in its vertex, capable of varying the diameter of the orifice from 30% to 50% of the basic diameter. The inverted cone (7) is located at the lower end of the said second vertical section (6) which connects the interconnections between the risers and the separator vessel (1). The diameter of the orifice is designed in accordance with the anticipated flow of spent catalyst, but can be regulated in such a way that the spent catalyst draws the minimum of gas to pass through the orifice.

The particles of spent catalyst which still remain in the suspension, due to their incomplete separation in the vertical section (6) of the interconnections between the risers and the separator vessel (1), of the order of 10% to 15% of the total quantity of active catalyst initially present in the risers, are subjected to the next stage of the separation process. The suspension retained in the vertical section (6) is forced to enter the cyclones without sealing legs (8), where the particle phase undergoes rapid separation while at the same outlet in the open lower parts (13) of the cyclones without sealing legs (8), in the direction of the fluidized bed (12) present in the separator vessel (1), and the gaseous phase passes via overhead ducts (10) of the cyclones without sealing legs (8) until it enters the first stage cyclones (9) where the final stages are carried out of separation of the gaseous hydrocarbons, which then pass for subsequent treatment via overhead ducts (14) of the cyclones of the first stage (9). The cyclones without sealing legs (8) are connected to the walls of the lower third of the second vertical section (6) of the interconnections of the risers at a distance of 2 to 3 times the diameter of the said vertical section (6) of the interconnections, around the lower end of the vertical section, at least 3 in number and equidistant from one another by 120°. Preferentially, the cyclones without sealing legs (8) are used in fours and are connected to the vertical section (6) of the interconnections of the risers in diametrically opposed positions. The conventional cyclones of the first stage (9) must be of the same number of the cyclones without sealing legs (8).

The catalyst particles drawn to this point by the flow of ascending gases are once again separated and descend to the fluidized bed of the catalyzer (12) of the separator vessel (1) via the sealing legs (11) of the primary cyclones, the lower ends of which are immersed or not in the said fluidized bed (12). The configuration of the cyclones of the first stage (9), as well as the sealing shape of the legs, may be any one of those encountered in the state of the art.

It should be noted that, in order to render the description of the system as simple as possible, FIG. 1 shows only two of the four cyclones considered necessary for the most satisfactory functioning of the system, both those without sealing legs (8) as well as those of the first stage (9).

Figure 2:
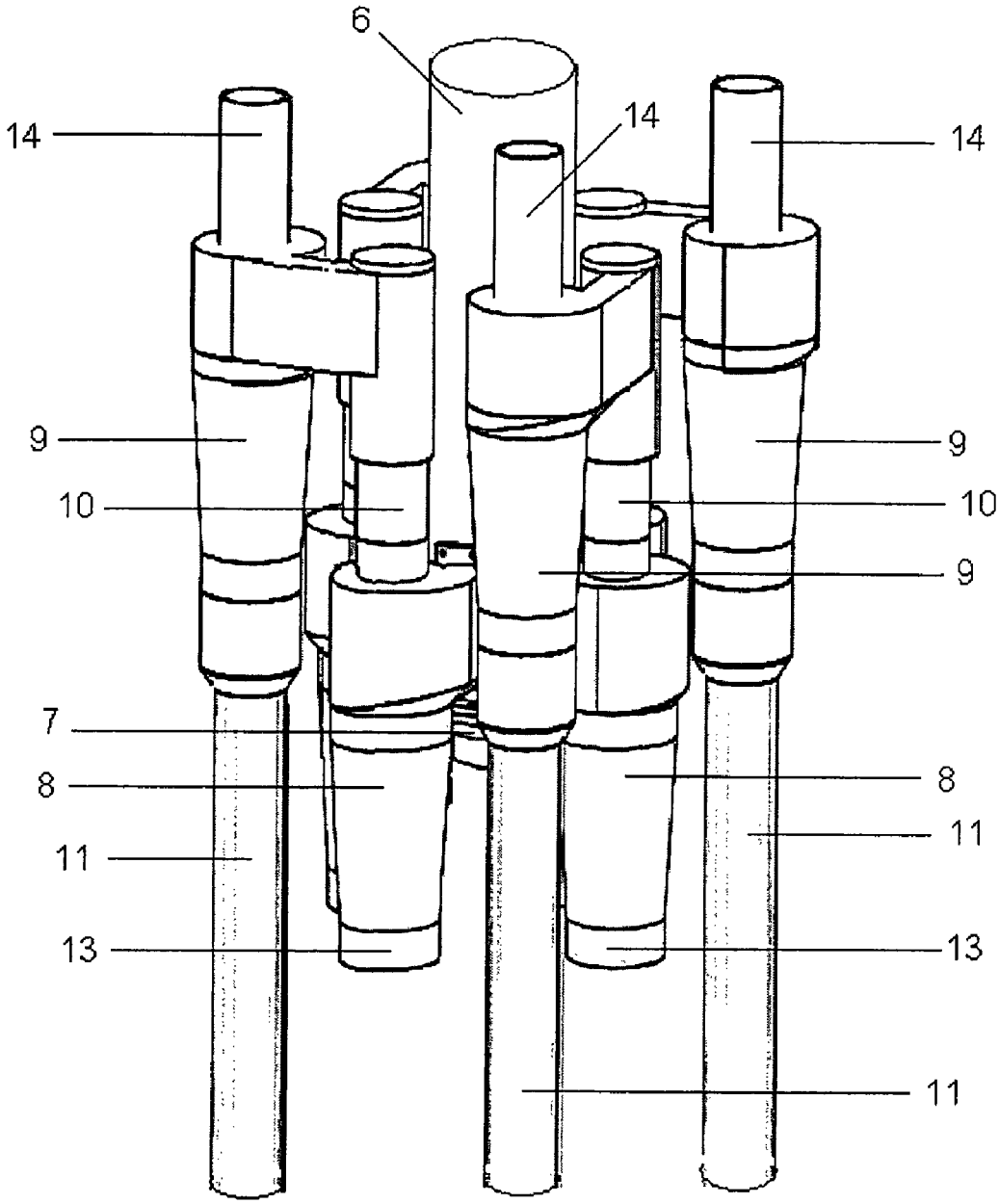
FIG. 2 shows a diagrammatic representation in a perspective view of the preferred system for the separation of suspensions of spent catalysts and hydrocarbons formed in fluid catalytic cracking units (FCCUs) with multiple ascending flow reaction tubes, "risers", of the present invention.
Figure 3:
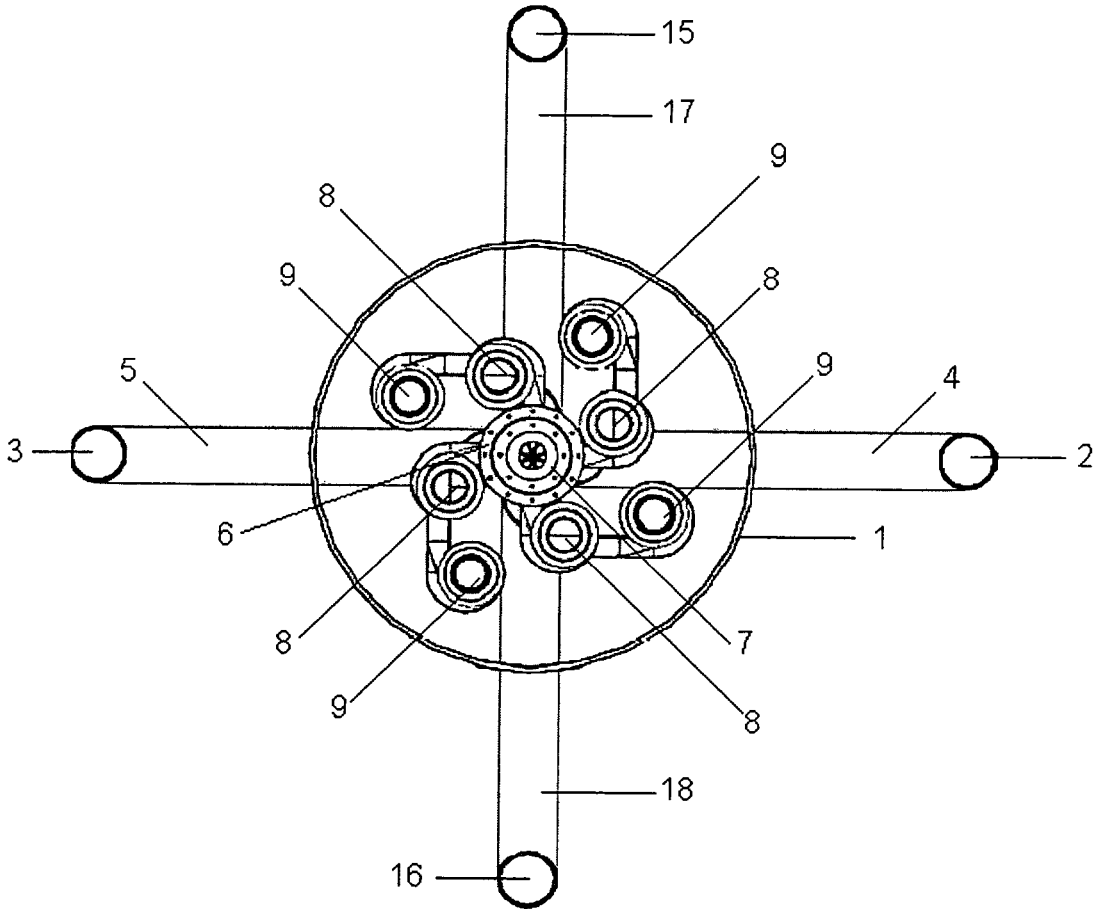
FIG. 3 shows a diagrammatic representation of a view from below of a horizontal section of the internal part of the separator vessel of the preferred system for the separation of suspensions of spent catalysts and hydrocarbons formed in fluid catalytic cracking units (FCCUs) with multiple ascending flow reaction tubes, "risers", of the present invention.

FIGS. 2 and 3 are appended in order to illustrate one of the preferred configurations of the system for separating emulsions of spent catalysts and hydrocarbons of the present invention.

FIG. 2 shows a perspective view of a possible FCC unit equipped with two more risers in parallel (15 and 16), shown in detail in FIG. 3, as well as the risers (2 and 3) shown in FIG. 1, and a possible configuration of how the separation system of the present invention would function installed in this.

FIG. 3 shows a view from below of a horizontal section of the internal part of the separator vessel of the system equipped with two more risers in parallel (15 and 16), as well risers (2 and 3) with their respective inclined sections (17 and 18) connected to the vertical section (6) of the interconnections between the risers and the separator vessel (1), as it would function in the configuration proposed above.

The present invention will now be illustrated by an example, which, however, must not be considered as limitative but viewed simply as a means of demonstrating that the objectives of the invention are fully attainable.

EXAMPLE

Tests were carried out in a pilot plant, in which the efficiency of the separation system of the present invention was tested against a separation system of the prior state of the art, under similar operating conditions.

To assess the results obtained from the tests, the following principal aspects were considered:

a) Visual quality of the discharge at the intake of the separation systems;
b) Pressure profile in the unit, under different operational conditions;
c) Efficiency of the assessment of the cyclones; and
d) Erosion at the intake of the cyclones without sealing legs.

The flow conditions for the tests were:

a) Summary total of the flows of non-sulphated air in the risers: 800 $m^3/h$
b) Summary total of the flows of catalyst in circulation in the risers varying between 8000 and 10000 kg/h.

The catalyzers used in the tests were of the balance catalyzer type. One of them had a particle distribution size with a fraction of between 0 and 40 μm, in the range from 13% to 17%, and the other, also with a particle distribution size with a fraction of between 0 and 40 μm, in the range of 3%.

The efficiency of the yield was measured by quantifying the quantity of catalyst lost in the balance separation system, from the movement of the "flapper" valve of an assessment cyclone in the pilot plant, and in consideration of the time between the opening and closing of this valve, as well as the level of catalyst formed in the sealing leg of the cyclone.

Figure 4:
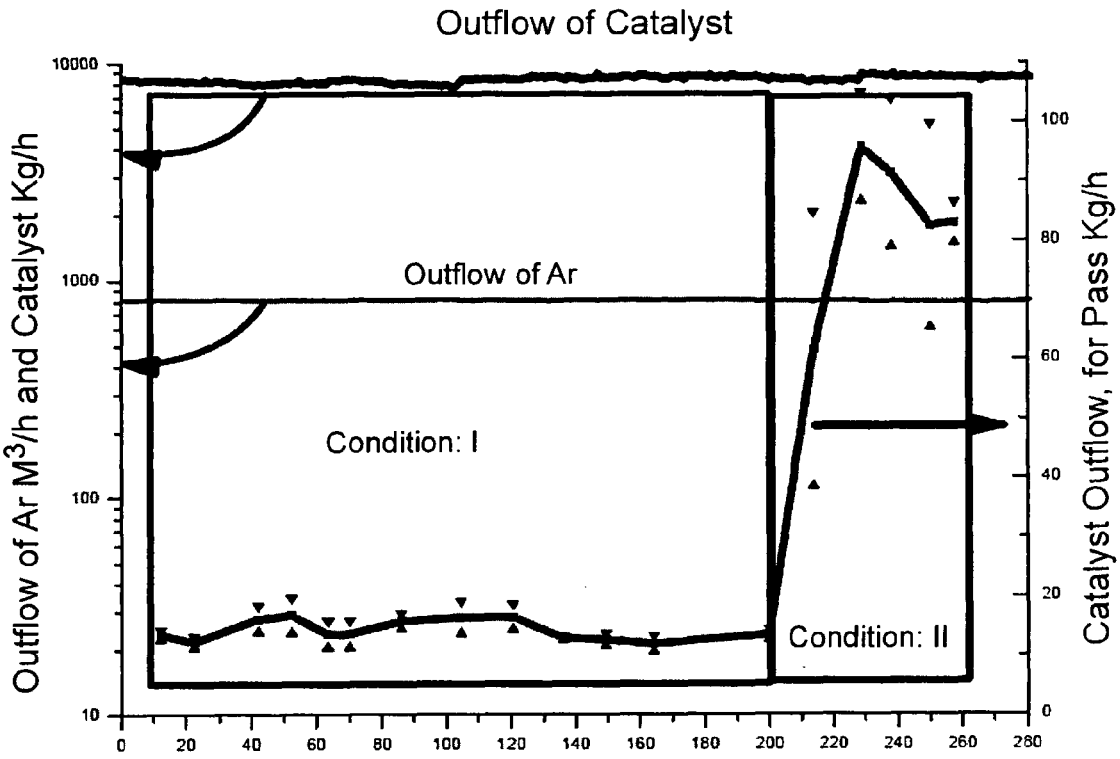
FIG. 4 shows a graph representing the operational variables of the test carried out in a pilot plant, in which the results are shown which were obtained in the assessment of spent catalysts separated by the system of the present invention.

As is shown by the graph of the operation of the pilot plant shown in FIG. 4, the efficiency of the yield from the separation system of the present invention achieves a value of 99.8%, in weight 20 kg/h in 10,000 kg/h of the catalyst fed in the riser to the assessment cyclone or the first stage when operated with the orifice of the inverted cone (7) of the second vertical section (6) of the interconnection of the risers with the separator vessel (1) open or discharging into the separator vessel, indicated in FIG. 4 as Condition I.

The results obtained for gas-solid separation according to the prior state of the art, without the use of pre-preparation or with the orifice of the inverted cone (7) of the second vertical section (6) of the interconnection of the risers with the separator vessel, indicated in FIG. 4 as Condition II, indicates that the catalyst flow drawn to the assessment cyclone or the first stage increases from 15 kg/h to 90 kg/h, which signifies a maximum total efficiency result of 99% in weight, or a draw of six times more catalyst to the first stage cyclone (9).

The separation system of the present invention also presents better results with regard to corrosion, given that, with the reduction of the catalyst flow to the cyclones, the occurrence of instability in the catalyst flow at the cyclone intakes is reduced, as is the erosion at their intakes.

The invention claimed is:

1. System for the separation of suspensions of spent catalysts and hydrocarbons formed in a fluid catalytic cracking unit with multiple ascending flow reaction tubes, characterised in that it consists of:

a) Interconnections between each of the ascending flow reaction tubes (2, 3, 15, 16) and the separator vessel (1) consisting of two sections connected to one another, the first inclined section (4, 5, 17, 18) beginning at the upper end of the ascending flow reaction tubes (2, 3, 15,16), forming an acute angle with them, and enclosing the top of the outer part of the second vertical section (6) of the interconnection, which penetrates into the centre of the upper cover of the separator vessel (1) and which has a regulatable opening device, connected at its lower end, for the draining of the part of the spent catalyst separated from the suspensions;
b) Cyclones without sealing legs (8), located in the interior of the separator vessel (1), connected directly to the walls of the lower third of the said second vertical section (6) of the interconnections described in a); and
c) Conventional cyclones of the first stage (9), also located in the interior of the separator vessel (1), connected to the cyclones without sealing legs (8) described in b) by way of two overhead ducts for the outlet of gases and the sealing legs (11) of which, provided or not with controlling devices for the retention of solids, extend or not as far as the interior of the fluidized bed (12) located in the separator vessel (1).

2. System for the separation of suspensions of spent catalysts and hydrocarbons formed in a fluid catalytic cracking unit with multiple ascending flow reaction tubes according to claim 1, characterised by the acute angle formed between the ascending flow reaction tubes (2, 3, 15, 16) and the first inclined sections (4, 5, 17, 18) which comprise the interconnections between the ascending flow reaction tubes (2, 3, 15, 16) and the separator vessel (1) varies in the range from 35° to 50°.

3. System for the separation of suspensions of spent catalysts and hydrocarbons formed in a fluid catalytic cracking unit with multiple ascending flow reaction tubes, according to claim 1, characterised in that the device for draining the spent catalyst from the suspensions is an inverted cone (7) and is connected by its base to the lower end of the vertical section (6) of the interconnections from a), forming an angle of between 50° and 70° with its generatrix and is provided with a regulatable opening orifice in its vertex.

4. System for the separation of suspensions of spent catalysts and hydrocarbons formed in a fluid catalytic cracking unit with multiple ascending flow reaction tubes, according to claim 3, characterised in that the diameter of the orifice of the inverted cone varies from 30% to 50% of the diameter of the base, the value being defined by the quantity of spent catalyst present in the unit.

5. System for the separation of suspensions of spent catalysts and hydrocarbons formed in a fluid catalytic cracking unit with multiple ascending flow reaction tubes, according to claim 1, characterised in that the cyclones without sealing legs (8) are connected to the walls of the lower third of the second vertical section (6) of the interconnections of the ascending flow reaction tubes, at a distance of two to three times the diameter of the said vertical section (6) of the interconnections, around the lower end of the said vertical section (6).

6. System for the separation of suspensions of spent catalysts and hydrocarbons formed in a fluid catalytic cracking unit with multiple ascending flow reaction tubes, according to claim 5, characterised in that the cyclones without sealing legs (8) are at least three in number, and are connected to the vertical section (6) of the interconnections of the ascending flow reaction tubes and are equidistant between one another by 120°.

7. System for the separation of suspensions of spent catalysts and hydrocarbons formed in a fluid catalytic cracking unit with multiple ascending flow reaction tubes, according to claim 6, characterised in that the cyclones without sealing legs (8) are, for preference, four in number and are connected to the vertical section (6) of the interconnections of the ascending flow reaction tubes diametrically opposite.

8. System for the separation of suspensions of spent catalysts and hydrocarbons formed in a fluid catalytic cracking unit with multiple ascending flow reaction tubes, according to claim 1, characterised in that the conventional cyclones of the first stage (9) are of the same number as the cyclones without sealing legs (8).

9. Process for the separation of suspensions of spent catalysts and hydrocarbons formed in a fluid catalytic cracking unit with multiple ascending flow reaction tubes, characterised in that it consists of the following stages:

a) Feeding of loads composed of catalysts and hydrocarbons into each of the ascending flow reaction tubes (2, 3, 15, 16) of a fluid catalytic cracking unit with multiple ascending flow reaction tubes, using the separation system described in claim 1;

b) Subjecting the loads to a fluid catalytic cracking reaction in each of the ascending flow reaction tubes (2, 3, 15, 16);

c) After the reaction in (b) has taken place, the suspensions of particles of spent catalysts and cracked hydrocarbons produced in the said reaction and expelled through the upper ends of each of the ascending flow reaction tubes (2, 3, 15, 16) reach the first inclined sections (4, 5, 17, 18) of the interconnections between each of the ascending flow reaction tubes (2, 3, 15, 16) and the separator vessel (1); they then move in descending flow until they arrive at the second vertical section (6) of the interconnections between each of the ascending flow reaction tubes (2, 3, 15, 16) and the separator vessel (1), where the particles of spent catalyst begin to separate from the cracked hydrocarbons, and drain off to the interior of the separator vessel (1) through the central orifice of the inverted cone (7) which is connected to the lower end of the second vertical section (6) of the interconnections between each of the ascending flow reaction tubes (2, 3, 15, 16) and the separator vessel (1);

d) Forcing the suspension with the spent catalyst remaining from the draining process through the central orifice of the inverted cone (7), to penetrate into the cyclones without sealing legs (8), where more particles of spent catalyst are separated and drain into the interior of the separator vessel (1) through the lower open parts (13) of the cyclones without sealing legs (8), while the gaseous cracked hydrocarbons separated from the suspension pass through overhead ducts (10) of the said cyclones without sealing legs (8) and reach the conventional cyclones of the first stage (9) in order to undergo one more separation stage; and e) Releasing the said gaseous cracked hydrocarbons from the fluid cracking unit through overhead ducts (14) of the conventional cyclones of the first stage (9) to subsequent processing, while the particles of spent catalysts, separated from the suspension, drain via the sealing legs (11) of the conventional cyclones of the first stage (9), enter the fluidized bed (12), and, after correction in the separator vessel (1), follow into the process in order to be regenerated and reused.

10. Process for the separation of suspensions of spent catalysts and hydrocarbons formed in a fluid catalytic cracking unit with multiple ascending flow reaction tubes, according to claim 9, characterised in that the loads fed into each of the ascending flow reaction tubes (2, 3, 15, 16) can make use of mass flows, catalyst/hydrocarbon ratios, and mixtures of different hydrocarbons.

11. Process for the separation of suspensions of spent catalysts and hydrocarbons formed in a fluid catalytic cracking unit with multiple ascending flow reaction tubes, according to claim 9, characterised in that the fluid catalytic cracking reactions in each of the ascending flow reaction tubes (10) must be conducted under isobaric conditions and using the same catalyst.

* * * * *